US007618214B2

(12) United States Patent
LeBlanc et al.

(10) Patent No.: US 7,618,214 B2
(45) Date of Patent: Nov. 17, 2009

(54) CONTAINMENT BOOM GUIDE SYSTEM AND METHOD

(75) Inventors: David LeBlanc, Youngsville, LA (US); Nassar Donald, Jr., Carencro, LA (US)

(73) Assignee: Maritime International, Inc., Broussard, LA (US)

( * ) Notice: Subject to any disclaimer, the term of this patent is extended or adjusted under 35 U.S.C. 154(b) by 0 days.

(21) Appl. No.: 11/701,622

(22) Filed: Feb. 2, 2007

(65) Prior Publication Data

US 2007/0201953 A1 Aug. 30, 2007

Related U.S. Application Data

(60) Provisional application No. 60/764,958, filed on Feb. 3, 2006.

(51) Int. Cl.
*E02B 15/08* (2006.01)

(52) U.S. Cl. ..... 405/63; 210/170.05; 210/923

(58) Field of Classification Search ..... 210/170.01, 210/170.05, 923; 405/63, 65, 66
See application file for complete search history.

(56) References Cited

U.S. PATENT DOCUMENTS

| | | | | |
|---|---|---|---|---|
| 3,184,923 | A | | 5/1965 | Galvaing |
| 3,685,296 | A | | 8/1972 | Bogosian |
| 3,766,738 | A | | 10/1973 | Gauch |
| 3,786,637 | A | * | 1/1974 | Muramatsu et al. ..... 405/72 |
| 3,800,542 | A | * | 4/1974 | Cerasari ..... 405/72 |
| 3,834,538 | A | | 9/1974 | Laman |
| 3,859,796 | A | | 1/1975 | Benson |
| 3,903,701 | A | * | 9/1975 | Gauch ..... 405/66 |
| 3,971,220 | A | * | 7/1976 | Kinase et al. ..... 405/66 |
| 4,003,206 | A | | 1/1977 | Tanksley |
| 4,016,726 | A | | 4/1977 | Campbell et al. |
| 4,033,137 | A | * | 7/1977 | Geist ..... 405/71 |
| 4,116,833 | A | * | 9/1978 | Stagemeyer et al. ..... 210/776 |
| 4,146,344 | A | * | 3/1979 | Steen et al. ..... 405/68 |
| 4,248,547 | A | * | 2/1981 | Brown ..... 405/72 |
| 4,640,645 | A | | 2/1987 | Simpson et al. |
| 5,054,960 | A | * | 10/1991 | Manzano et al. ..... 405/72 |
| 5,120,159 | A | * | 6/1992 | Smith ..... 405/66 |
| 5,188,482 | A | * | 2/1993 | Braun ..... 405/70 |
| 5,267,813 | A | * | 12/1993 | Neal ..... 405/72 |
| 5,580,185 | A | | 12/1996 | Ware |
| 6,854,927 | B2 | | 2/2005 | Miyazaki |
| 2005/0117972 | A1 | | 6/2005 | Dreyer |

* cited by examiner

*Primary Examiner*—Tara Mayo-Pinnock
(74) *Attorney, Agent, or Firm*—Pamela A. Baxter; Kean, Miller, Hawthorne, D'Armond, McCowan & Jarman LLP

(57) ABSTRACT

A containment boom guide system for guiding and containing a floating containment boom to a fixed structure such as a pier, ship, column, dock, sea wall, or other like structure. The guide system is made up of one or more boom guide(s) and allows lateral and vertical movement of the floating containment boom while keeping the boom secure to the fixed structure.

4 Claims, 3 Drawing Sheets

CONTAINMENT BOOM GUIDE SYSTEM AND METHOD

CROSS REFERENCE TO RELATED APPLICATIONS

This application claims the benefit of prior U.S. provisional application Ser. No. 60/764,958 filed on Feb. 3, 2006 which is hereby incorporated by reference in its entirety.

BACKGROUND

The present invention relates to a boom guide system. More particularly, the invention relates to a containment boom guide system comprising one or more boom guide(s) used in guiding and containing a floating containment boom to a fixed structure such as a pier, ship, column, dock, sea wall, or other like structure.

Floating containment booms are utilized to confine materials such as oil, gas or other pollutants from spreading on the surface of a liquid including but not limited to a river, lake or ocean. Containment of an oil spill is the process of preventing its spread by confining the oil, gas or other pollutants to the area where it has been discharged. Containment booms can be used temporarily or permanently to contain spills in these bodies of water and certain types of booms can be used permanently around dock areas where there is a potential recurrence of pollutant spills caused by the docked ships.

Containment booms come in many different shapes, sizes and styles ranging from small models intended for manual deployment in harbors, to large, robust units which usually need cranes and sizeable vessels designed for the open seas to handle them. In waters having varying tide conditions, the floating containment boom must rise and fall with the tide to confine the pollutants floating on the surface.

Containment booms may be comprised of a plurality of boom segments that extend over a body of water to form an elongate, moderately flexible skirt. Containment booms generally incorporates the following features: (1) freeboard to prevent or reduce splash-over; (2) sub-surface skirt to prevent or reduce escape of oil under the boom; (3) flotation by air or some buoyant material; and (4) longitudinal tension member such as a chain or wire to provide strength to withstand the effects of winds, waves and currents.

Floating containment booms can be affixed at one or both ends thereof to a fixed structure such as a pier, ship, column, dock, sea wall, or other like structure to keep the containment boom in place. Various devices have been utilized to attach the ends of the floating containment booms to fixed structures such as piers, docks, and other like structures. These devices must allow the containment booms to rise and fall with the tide.

There are several patents which disclose a device for affixing the ends of a containment boom to a fixed structure or to another boom. U.S. Pat. Nos. 3,766,738; 4,016,726; and 4,003,206 each disclose a device for affixing the end of a floating boom to a fixed structure while allowing the containment boom to rise and fall with the tide. Other patent applications disclose devices and methods for attaching booms to each other such as the inventions disclosed in U.S. Pat. Nos. 3,859,796 and 3,685,296.

While there are several designs for devices to attach the end of a containment boom to a fixed structure and attach the end of a containment boom to other sections of containment booms, the art demonstrates a need for a boom guide system that stabilizes the body of the containment boom near a fixed structure such as a pier, ship, column, dock, sea wall, or other like structure so that the body of the boom will not float away from the structure. The only systems that are currently in use for stabilizing the body of the containment boom utilize crude cable systems that are unreliable, hard to maintain, and pose a danger to those working at the base of the to a fixed structure such as a pier, ship, column, dock, sea wall, or other like structure due to entanglement of the cables in equipment.

SUMMARY

In accordance with the present disclosure there is provided a boom guide system for guiding and containing a containment boom comprising one or more boom guides, each said boom guide comprising a boom guide body and a means for securing said boom guide body to a piling or other like structure.

The boom guide disclosed herein is technically advantageous because its design may allow for long life, low maintenance, and ease of installation. In addition, the boom guide is technically advantageous because the guide system may provide at least one boom guide through which the containment boom will be allowed to move freely laterally along the face of a fixed structure, such as a pier, ship, column, dock, sea wall, or other like structure, as well as moving vertically during change in tidal/wave action.

These and other advantages and features of this invention will be apparent from the following description.

BRIEF DESCRIPTION OF THE DRAWINGS

These and other features, aspects, and advantages of the present invention will become better understood with regard to the following description, appended claims, and accompanying drawings where:

DETAILED DESCRIPTION

The following descriptions are of preferred embodiments, and are not intended to limit the scope, applicability, or configuration of the invention in any way. Rather, the following description provides a convenient illustration for implementing a preferred embodiment of the invention. Various changes may be made in the function and arrangement of elements described in the preferred embodiments without departing from the spirit and scope of the invention as set forth in the appended claims.

Figure 1:
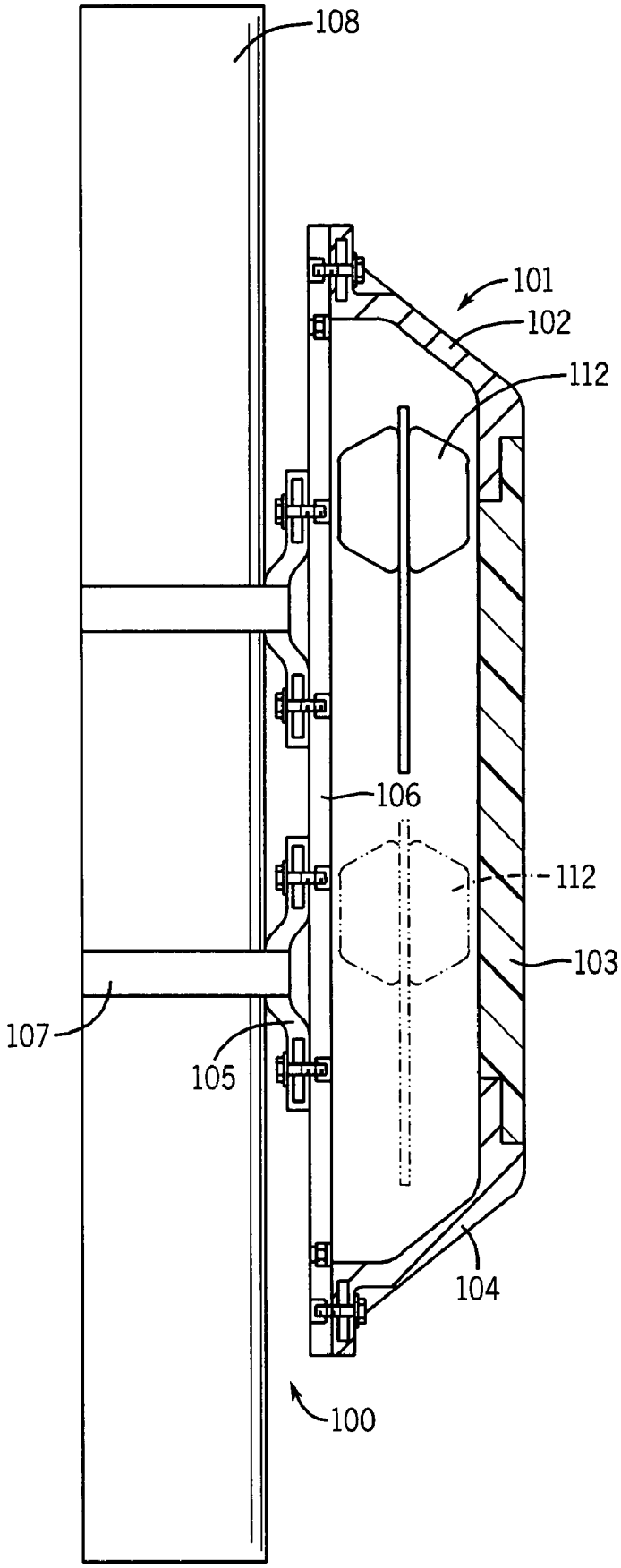
FIG. 1 shows a profile view of a preferred embodiment of a single boom guide 100 attached to piling 108 depicting an overview of the components of each boom guide 100 with relative positions of a floating containment boom 112 while boom guide 100 is in operation.

Turning now to FIG. 1, there is shown a preferred embodiment of a boom guide 100 comprising boom guide body 101, mounting blocks 105, and straps 107 which mount the boom guide 100 to piling 108. A "piling" is generally defined as a column or support made of a rigid material such as wood, metal, plastic, concrete, or other like material which is connected to and may offer support to a fixed structure such as a pier, ship, column, dock, sea wall, or other like structure.

The boom guide body shall define an opening for guiding and containing a containment boom. Each boom guide body 101 may be made of any rigid or semi-rigid materials such as metal, composite materials, plastics or other like materials. However, it is preferred that the body of the boom guide be made up of a composite, substantially non-corrosive material that is capable of deflecting under load to prevent substantial damage to the boom guide body 101 while still maintaining structural integrity of the boom guide body 101 and preventing substantial damage to the floating containment boom during normal operations. "Composite materials" are generally defined as any material made from two or more constituent materials that remain separate and distinct on a macroscopic level while forming a single component, including but not limited to materials such as fiber reinforced plastics, metal matrix composites, ceramic matrix composites, and engineered wood.

A boom guide system is comprised of one or more boom guides 100 used in guiding and containing the body of a floating containment boom 112 to a fixed structure such as a pier, ship, column, dock, sea wall, or other like structure. A boom guide system shall serve to support a floating containment boom 112 which forms a barrier on the surface of a liquid. The containment boom 112 may be rigidly attached to the fixed structure at both terminating ends of the containment boom 112 allowing the portion of containment boom 112 between the terminating ends to move freely. On the other hand, the containment boom 112 may not be rigidly attached to a fixed structure but rather may float freely such as in a circular design. The boom guide system can help restrict the containment boom 112 from being substantially pushed either away or under a fixed structure such as a such as a pier, ship, column, dock, sea wall, or other like structure without the need to rigidly attach the containment boom directly to the fixed structure along the middle portion of the containment boom. For example, the boom guide system can allow the containment boom 112 to move freely in two directions within the boom guide 100 i.e. the boom can move laterally to the face of the fixed structure and vertically during the change in tidal/wave action. In operation, the vertical movement is restrained by the boom guide 100 only by the space of the opening provided within the boom guide body 101 and the lateral movement will depend on how much slack is provided when the containment boom 112 is attached to the fixed structure at each terminating end of the containment boom 112.

As illustrated in FIG. 1, each boom guide 100 includes boom guide body 101, one or more mounting block(s) 105, and one or more removable strap(s) 107. The boom guide body 101 can be broken down into a base member 106, front member 103, top leg 102, and bottom leg 104 wherein base and front members 106 and 103 are joined to the top and bottom legs 102 and 104 as shown in FIG. 1. In this embodiment, the top leg and the bottom leg project outwardly from the base member and the base member 103 and front member 106 are substantially parallel to each other, although in other embodiments, the front member may not be substantially parallel to said base member. For example, the front member may be of an arched design. The upper end of the base member 103 and front member 106 are joined to top leg 102 and the lower end of the base member 103 and front member 106 are joined to bottom leg 104 by way of fasteners or fastening means such as bolts, screws, welding or other equivalent connection. The different components that comprise the boom guide body 101 can be made of different materials depending on operating conditions. In addition, the mounting blocks 105 and straps 107 may be fastened to the boom guide body 101 in a position so that the boom guide 100 can be connected to piling 108. Piling 108 may be orientated varying positions such as vertical, horizontal, or any orientation in between vertical and horizontal.

Mounting brackets 105 are fastened to base member 106 by way of fasteners or fastening means such as bolts, screws, welding or other equivalent connection. Mounting brackets 105 provide a passage for receiving strap 107. There are other alternatives to utilizing mounting bracket 105, such as positioning strap 107 through boom guide body 101 in order to attach boom guide body 101 directly to piling 108. In addition, boom guide body 101 may be fastened directly to the piling by way of fasteners such as lag bolts or anchors without the need of strap 107.

In another preferred embodiment, the boom guide 100 shall be fastened to a piling or other like structure by way of a clamping system that includes strap 107 and clamping means such as a ratchet mechanism to secure strap 107 to the piling 108 or other like structure. It is preferred that strap 107 can be made of stainless steel which will be suitable for installation onto an irregular surface without hindering proper tensioning. However, securing strap 107 can be made of any metal, plastic, cloth, or other like material. It is also preferred that all fastening hardware such as ratchet mechanism associated with the straps be made of 316 stainless steel although other like non-corrosive rigid materials would also work.

In another preferred embodiment, the boom guide system 100 will be capable of deflecting under load perpendicular to the front member 103 without damaging the guide system. Also, it is preferred that the guide system shall be removable for servicing of the containment boom 112 or the boom guide 100 by way of a clamping means such as a ratchet mechanism which is preferably made of stainless steel although other materials can be used such as carbon steel or any other like rigid materials. It is preferred that the clamping means be designed so that they can be easily handled by on-site personnel without the need of special equipment.

Preferably, the material for the boom guide body guide 101 shall be any rigid or semi-rigid material such as a castable reinforced polyurethane which shall be the reaction product of 100% polytetramethylene ether glycol (PTMEG), and aromatic diamine, 2, 4, toluene diisocyanate and based urethane elastomer. Additionally, it is preferred that the boom guide material be reinforced with the necessary additives for resistance to aging, seawater, abrasion, and ultraviolet rays.

Figure 2:
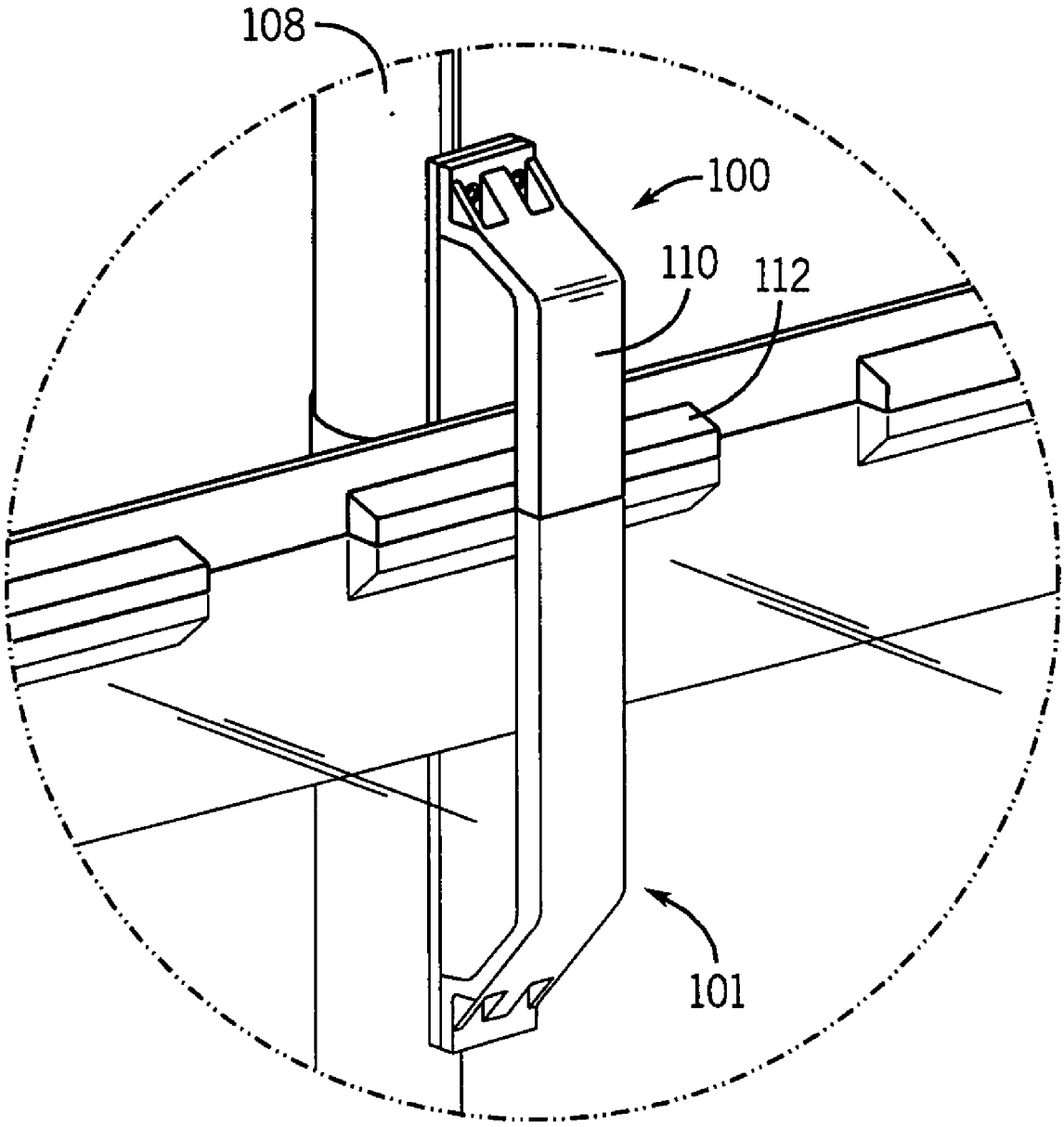
FIG. 2 shows a perspective view of a preferred embodiment of a single boom guide 100 attached to piling 108 depicting a floating containment boom 112 while boom guide 100 is in operation.

Shown in FIG. 2 is a perspective view of a single boom guide 100 in operation. The containment boom 112 is substantially held in place by the boom guide while providing space above and below the containment boom allowing for water elevation fluctuations.

Figure 3:
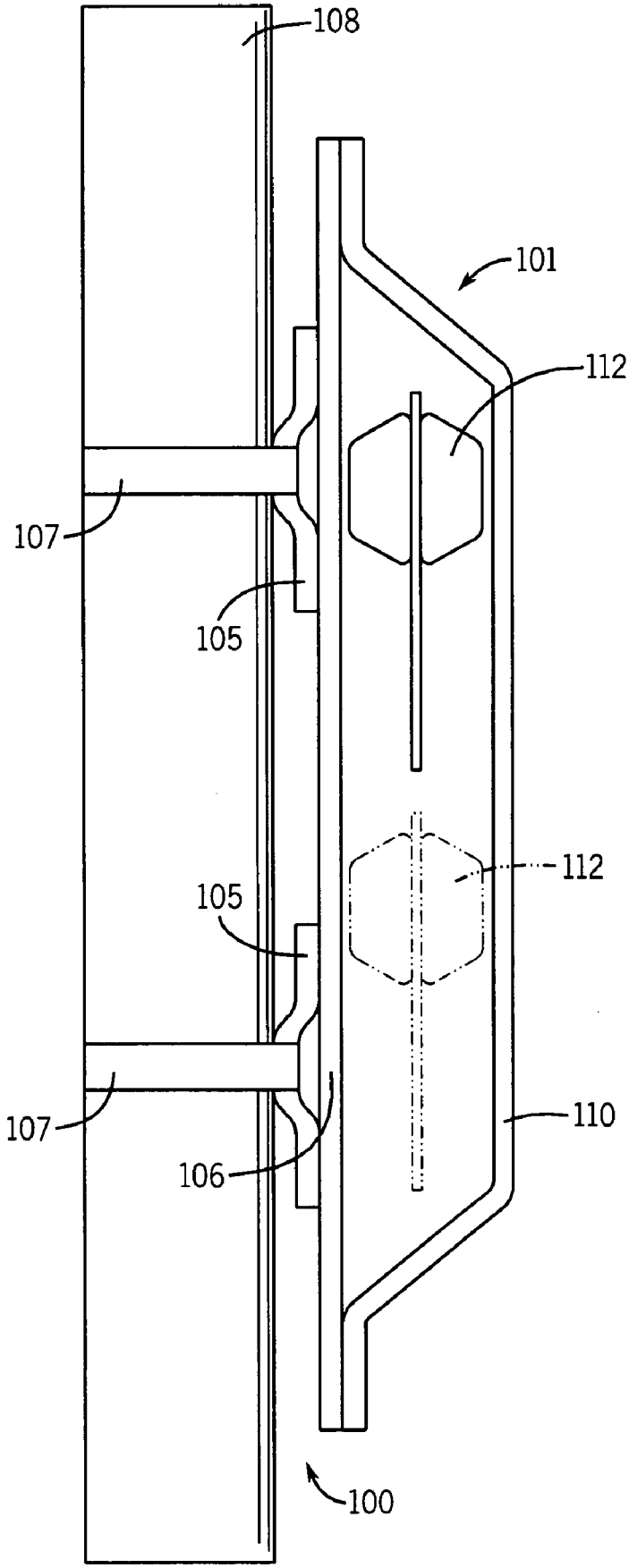
FIG. 3 shows a profile view of boom guide 100 attached to piling 108 depicting an alternate embodiment of boom guide components wherein boom guide is comprised of base member 106 and C-shaped member 110 with relative positions of a floating containment boom 112 while boom guide 100 is in operation.

Turning now to FIG. 3, there is shown a preferred embodiment of the boom guide comprising boom guide body 101 and mounting blocks 105 with straps 107 attaching the boom guide 100 to piling 108.

As illustrated in FIG. 3, the boom guide body 101 is comprised of a C-shaped member 110 and base member 106 wherein C-shaped member 110 is joined at both ends to base member 106 by way of fasteners or fastening means such as bolts, screws, welding or other equivalent connection. Alternatively, C-shaped member 110 and base member 106 may also be joined such that boom guide body 101 is essentially one solid piece of material. The C-shaped member can be in any shape that when secured or fastened to a piling or base member defines a opening for the containment boom.

In an alternative embodiment, C-shaped member 110 may be attached directly to the piling by way of fasteners or straps. In this embodiment, the base member 106 would be replaced by the face of the piling 108 to which the C-shaped member is attached.

The invention claimed is:

1. A boom guide system for guiding and containing a containment boom comprising one or more boom guides, each said boom guide comprising:

a) a base member;

b) a top leg fastened to said base member said top leg projecting outwardly from said base member;

c) a bottom leg fastened to said base member said bottom leg projecting outwardly from said base member;

d) a front member fastened to said top leg and said bottom leg wherein said front member, said top leg, said bottom leg, and said base member define an opening for guiding and containing a containment boom and wherein said front member is substantially parallel to said base member;

e) at least one or more mounting brackets fastened to said base member; and f) at least one or more straps positioned through said mounting brackets and around a piling.

2. The boom guide system of claim 1 further comprising a clamping means for securing said strap to said piling.

3. The boom guide system of claim 2 wherein said top leg and said bottom leg are comprised of a composite, substantially non-corrosive material capable of deflecting under load to prevent substantial damage to said boom guide body and said containment boom while still maintaining structural integrity of said boom guide body during normal operations.

4. A boom guide system for guiding and containing a containment boom comprising one or more boom guides, each said boom guide comprising:

a. a base member;

b. a top leg fastened to said base member;

c. a bottom leg fastened to said base member;

d. a front member fastened to said top leg and bottom leg wherein said base member, said top leg, said bottom leg, and said front member defining an opening for guiding and containing said containment boom;

e. a mounting brackets fastened to said base member;

f. a strap for fastening said boom guide onto a piling; and g. a clamping means for securing said strap to said piling.

* * * * *